US009346581B2

(12) United States Patent
Seon et al.

(10) Patent No.: US 9,346,581 B2
(45) Date of Patent: May 24, 2016

(54) METHOD OF MANUFACTURING AND FIXING METAL LABEL

(71) Applicants: Jongjae Seon, Hanam-si (KR); Keonhee Seon, Hanam-si (KR)

(72) Inventors: Jongjae Seon, Hanam-si (KR); Keonhee Seon, Hanam-si (KR)

(73) Assignee: Kyung Jong Sun, Sinjang-Dong, Hanam-Si, Gyeonggi-D (KR)

( * ) Notice: Subject to any disclaimer, the term of this patent is extended or adjusted under 35 U.S.C. 154(b) by 164 days.

(21) Appl. No.: 14/444,950

(22) Filed: Jul. 28, 2014

(65) Prior Publication Data

US 2016/0023794 A1 Jan. 28, 2016

(51) Int. Cl.

| | |
|---|---|
| ***B65C 7/00*** | (2006.01) |
| ***B65C 5/00*** | (2006.01) |
| ***B44C 3/08*** | (2006.01) |
| *G09F 7/06* | (2006.01) |
| *A44C 15/00* | (2006.01) |
| *B21D 28/06* | (2006.01) |
| *B21D 39/03* | (2006.01) |
| *B21D 35/00* | (2006.01) |

(52) U.S. Cl.

CPC . *B65C 7/00* (2013.01); *B44C 3/082* (2013.01); *B65C 5/00* (2013.01); *A44C 15/004* (2013.01); *B21D 28/06* (2013.01); *B21D 35/001* (2013.01); *B21D 39/032* (2013.01); *G09F 7/06* (2013.01)

(58) Field of Classification Search

CPC ..... Y10T 29/49908; Y10T 29/49922; Y10T 29/49588; Y10T 29/49595; Y10T 29/5116; B44C 1/227; B44C 1/28; B44C 1/22; B65C 7/00; A41D 27/08; A44C 15/004; G09F 7/06; G09F 7/02

USPC ..... 40/622, 596, 595

See application file for complete search history.

(56) References Cited

U.S. PATENT DOCUMENTS

| | | | | | |
|---|---|---|---|---|---|
| 1,068,484 | A * | 7/1913 | Colgan | G09F 7/06 | 40/622 |
| 1,219,284 | A * | 3/1917 | Freedman | G09F 7/08 | 40/620 |
| 1,514,184 | A * | 11/1924 | Tabor | G09F 7/02 | 40/622 |
| 1,618,073 | A * | 2/1927 | Clarence | A45C 13/08 | 40/661.11 |
| 2,318,234 | A * | 5/1943 | Kluger | A45C 13/08 | 40/622 |
| 8,650,786 | B2 * | 2/2014 | Trigg | G09F 3/00 | 40/1.5 |
| 2005/0287301 | A1 * | 12/2005 | Ljubomirsky | B05D 3/12 | 427/256 |

* cited by examiner

*Primary Examiner* — Jason L Vaughan
*Assistant Examiner* — Amanda Meneghini
(74) *Attorney, Agent, or Firm* — John K. Park; Park Law Firm

(57) ABSTRACT

A method of manufacturing and fixing a metal label allowing for the logos or trademarks of products or companies to be displayed as characters or figures on the surfaces of various products includes: forming a metal label to have fixing legs and a connection member thinner than the metal label through etching; forming holes in a product and a backplate in positions corresponding to those of the fixing legs; cutting the connection member connecting the fixing legs; and fixing the metal label to the product and the backplate. By forming the fixing legs thinner than the metal label, sharpness in the edges of the metal label is obtained when the fixing legs are bent. A recess is formed in the backplate, thereby preventing the metal label or the fixing legs from protruding from the surface of the product or the backplate, whereby further improved quality of the product is obtained.

6 Claims, 12 Drawing Sheets

METHOD OF MANUFACTURING AND FIXING METAL LABEL

BACKGROUND OF THE INVENTION

1. Field of the Invention

The present invention relates, in general, to a metal label allowing for the logos or trademarks of products or companies to be displayed as characters or figures on the surfaces of various products, and, more particularly, to a method of manufacturing and fixing a metal label which may improve the sharpness of the metal label while easily and conveniently fixing the metal label to a product surface and preventing the metal label from protruding from the product surface.

2. Description of the Related Art

In general, metal labels representing product brands, company logos, or the like may be fixed to the surfaces of various products such as clothing, wallets or bags made of cloth, leather, or the like. Such metal labels have conventionally been attached to the surfaces of the aforementioned products using an adhesive.

However, in such a method of attaching metal labels to product surfaces using an adhesive, the attachment strength of the adhesive may deteriorate over time, resulting in a separation of the metal labels from the products. In a case in which external impacts are applied to the metal labels, the metal labels may often be separated from the products. In particular, in the case in which the metal labels are separated from the products for the aforementioned reasons, the adhesive may remain on the surfaces of the products, whereby the exterior appearances of the products may be marred and the quality thereof may deteriorate. In the end, such products may be shunned by consumers or users, and the lifespans thereof may be significantly reduced.

Thus, in recent years, the attachment of metal labels has not been performed using an adhesive. Instead, a method of directly fixing metal labels to products by forming the metal labels to have fixing legs, allowing the fixing legs to penetrate through the products, and bending the fixing legs has been used.

In addition, Korean Utility Model Registration No. 0153945 discloses a metal label for clothing, and Korean Utility Model Laid-Open Publication No. 20-2010-0009593 discloses a backplate for fixing a metal label that allows for the metal label to be strongly fixed to a product.

That is, in a state in which through holes are formed in the backplate to allow fixing legs of the metal label to be inserted thereinto, the fixing legs of the metal label penetrate through the product and the backplate and are then bent, whereby the metal label may be strongly fixed to the product without damage to the product. Even in a case in which the metal label is attached to the surface of a product made of soft cloth, the backplate may allow for a plurality of metal labels to be stably fixed and sustainably maintained.

However, the aforementioned metal label fixation method may not ensure sharpness in the edges of the metal labels due to bent portions of the fixing legs, resulting in deterioration in the sharpness of the metal labels. In a case of a metal label including a combination of a plurality of characters or figures, these parts may be individually manufactured and fixed, whereby the entirety of the metal label may not be evenly fixed.

That is, the existing metal label manufacturing process is undertaken by pressing a metal plate and individually performing punching on the metal plate in a state in which the fixing legs are connected, and the fixing legs protruding from the pressed part are allowed to penetrate through the product in a state in which the fixing legs are perpendicularly bent with respect to the metal label, whereby the metal label is fixed to the product. In bending the fixing legs, a connection portion between the metal label and the fixing legs may be curved to form a rounded portion. The rounded portion may protrude from the edges of the metal label, and prohibit the edges thereof from being sharp and continuous. In this case, the metal label may not have sharp edges due to the bent portions of the fixing legs.

In particular, in the case of an existing metal label including a combination of a plurality of characters or divided logos, such parts may be individually manufactured and be sequentially fixed to a fixing plate of a product. In such a fixation process, those individually manufactured parts may not be arranged evenly in a horizontal or vertical direction, and may often be fixed in a state of being inclined or displaced, resulting in deterioration in the quality of the product.

In addition, since the existing metal label fixation method may cause the metal label to excessively protrude from the surface of the product, the metal label may frequently contact surrounding objects when the product is carried, whereby the metal label may be destroyed or may damage the surrounding objects. Therefore, when used, a significant degree of caution may be required.

The foregoing is intended merely to aid in the understanding of the background of the present invention, and is not intended to mean that the present invention falls within the purview of the related art that is already known to those skilled in the art.

DOCUMENTS OF RELATED ART (Patent Document 1) Korean Utility Model Registration No. 0153945; and (Patent Document 2) Korean Utility Model Laid-Open Publication No. 20-2010-0009593

SUMMARY OF THE INVENTION

Accordingly, the present invention has been made keeping in mind the above problems occurring in the related art, and the present invention is intended to propose a method of manufacturing and fixing a metal label including: forming a metal label having fixing legs and a connection member which are thinner than the metal label through etching, forming holes in a product and a backplate in positions corresponding to those of the fixing legs, cutting the connection member of the fixing legs, and fixing the metal label to the product and backplate. Since a stepped portion is formed between the metal label and the fixing legs through etching, sharpness in the edge of the metal label may be maintained due to the stepped portion even when the fixing legs are bent. By reducing the thickness of the fixing legs, damage to the product may be minimized. In addition, a recess having a depth corresponding to the thickness of the metal label or the fixing legs may be formed in the backplate, thereby preventing the metal label or the fixing legs from protruding.

In order to achieve the above object, according to one aspect of the present invention, there is provided a method of manufacturing and fixing a metal label including: performing a label production process including a masking process performed on a metal plate by taping a portion of both surfaces of the metal plate corresponding to a metal label to be formed and taping a portion of one surface of the metal plate corresponding to fixing legs connected to the metal label, an etching process for etching the masked metal plate to retain the metal label and the fixing legs while allowing the fixing legs which have been further etched to be thinner than the metal label, and a bending process for bending the fixing legs from the metal label; performing a backplate production process in which insertion holes are formed in a backplate in positions corresponding to those of the fixing legs of the metal label; performing an object punching process in which through holes are formed in an object in positions corresponding to those of the fixing legs of the metal label; performing a label insertion process by inserting the fixing legs of the metal label into the through holes of the object; performing a backplate coupling process by allowing the fixing legs penetrating through the object to be inserted into the insertion holes of the backplate; and performing a label fixation process by bending the fixing legs protruding after penetrating through the backplate, wherein the label production process, the backplate production process, and the object punching process are separately performed, and then the label insertion process, the backplate coupling process, and the label fixation process are sequentially performed.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinbelow, preferred embodiments of the present invention will be described in detail with reference to the accompanying drawings.

It should be understood that the terms used herein and the appended claims are not necessarily limited to general and dictionary meanings, but should be interpreted based on the meanings and concepts corresponding to technical aspects of the invention as described herein.

Figure 1:
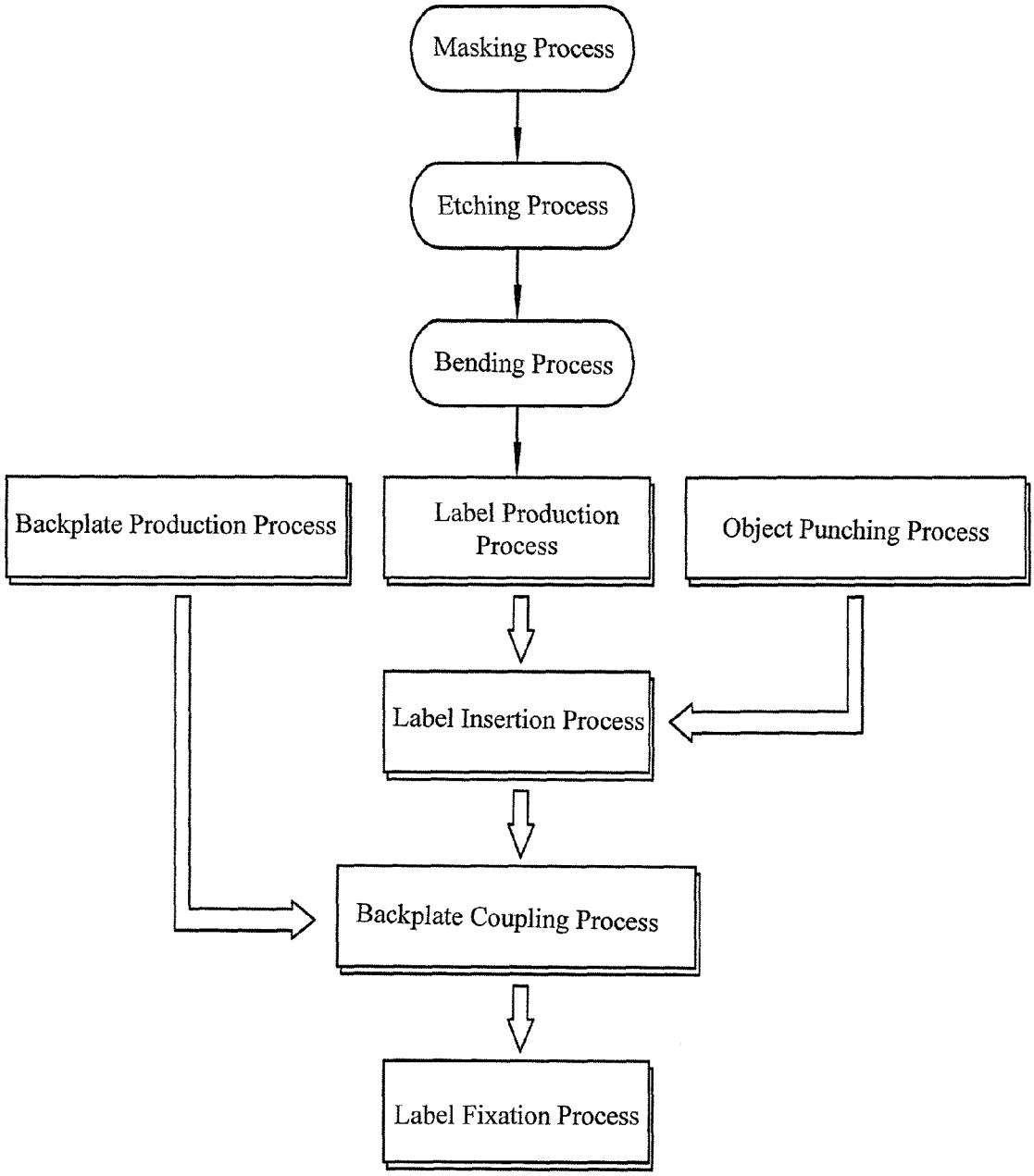
FIG. 1 is a view illustrating the whole process in a method of manufacturing and fixing a metal label according to an exemplary embodiment of the present invention.

FIG. 1 is a view illustrating the whole process in a method of manufacturing and fixing a metal label according to an exemplary embodiment of the present invention.

As illustrated in the accompanying drawings, the method of manufacturing and fixing a metal label according to an exemplary embodiment of the present invention may include forming metal labels 10 and 10' in a label production process, forming a backplate 20 in a backplate production process, and forming holes in an object 30 to which the metal labels are to be fixed in an object punching process.

In the label production process, a masking process may be performed on a metal plate having a uniform thickness. The shapes of the metal labels 10 and 10' to be formed, fixing legs 11 and 11' protruding from ends of the metal labels, and connection members 13 and 13' connecting the ends of the fixing legs 11 and 11' to each other in a case in which the metal labels 10 and 10' are formed of a combination of two or more labels may be masked on the metal plate.

Figure 2:
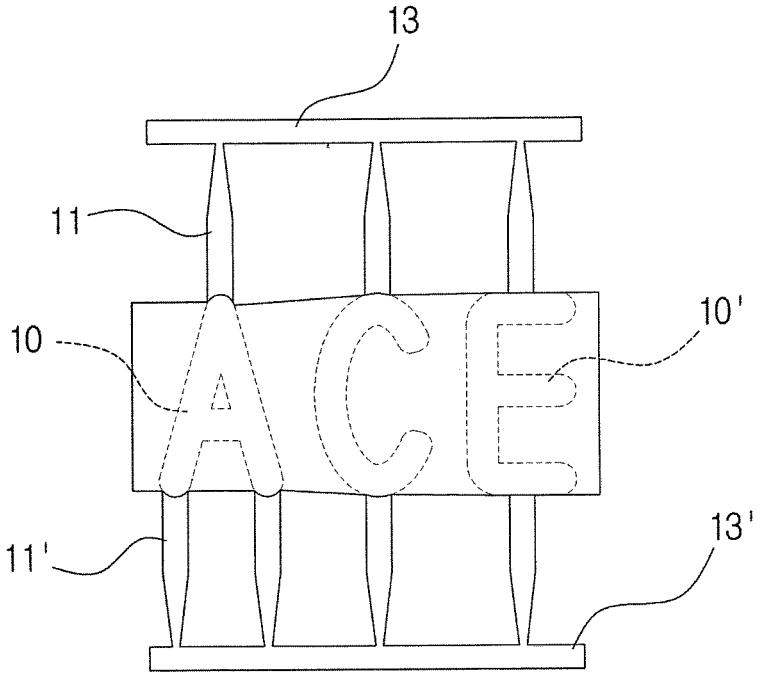
FIG. 2 is a view illustrating a masking process in the method of manufacturing and fixing a metal label according to the exemplary embodiment of the present invention.

Here, the masking process may be performed on portions of the metal plate corresponding to the metal labels 10 and 10' on both surfaces of the metal plate, and may be performed on portions of the metal plate corresponding to the fixing legs 11 and 11' or corresponding to the fixing legs 11 and 11' and the connection members 13 and 13' on one surface of the metal plate as illustrated in FIG. 2.

In this state, an etching process may be performed on the metal plate. The masked portions of both surfaces of the metal plate corresponding to the metal labels 10 and 10' may not be etched, while the masked portions of one surface of the metal plate corresponding to the fixing legs 11 and 11' may be half-etched. The remaining portion of the metal plate, except for the portions of the metal plate corresponding to the metal labels 10 and 10' and the fixing legs 11 and 11', may be etched and removed. Here, in a case in which the metal labels 10 and 10' are formed of a combination of two or more labels, the fixing legs 11 and 11' and the connection members 13 and 13' may be formed to be relatively thinner than the metal labels 10 and 10'. The thickness of the metal labels 10 and 10' may be maintained to be equal to an original thickness of the metal plate, while the thickness of the fixing legs 11 and 11' and the connection members 13 and 13' may be equal to or less than half of the original thickness of the metal plate.

Figure 3:
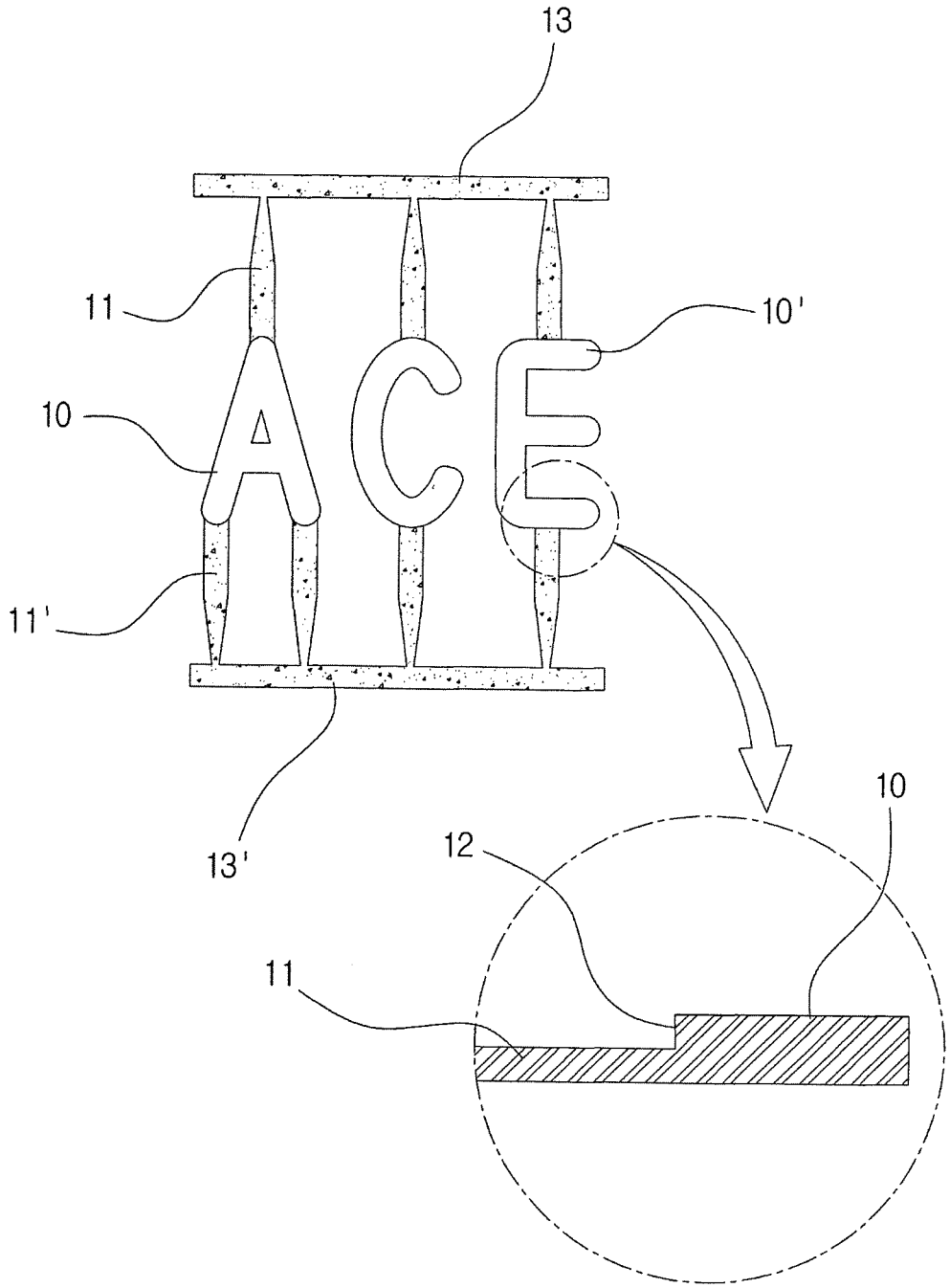
FIG. 3 is a view illustrating an etching process in the method of manufacturing and fixing a metal label according to the exemplary embodiment of the present invention.

Due to the aforementioned etching process, the thickness of the fixing legs 11 and 11' becomes thin as illustrated in FIG. 3. By allowing etched surfaces of the fixing legs 11 and 11' to correspond to exposed surface (which are exposed when the metal labels are fixed to a product) of the metal labels 10 and 10', a predetermined stepped portion 12 may be formed between the exposed surfaces of the metal labels 10 and 10' and the fixing legs 11 and 11'. Preferably, in a case in which the metal labels 10 and 10' have a thickness of 0.5 mm, the fixing legs 11 and 11' may be etched to have a thickness of 0.25 mm, and thus, the stepped portion 12 of 0.25 mm may be formed therebetween.

Figure 4:
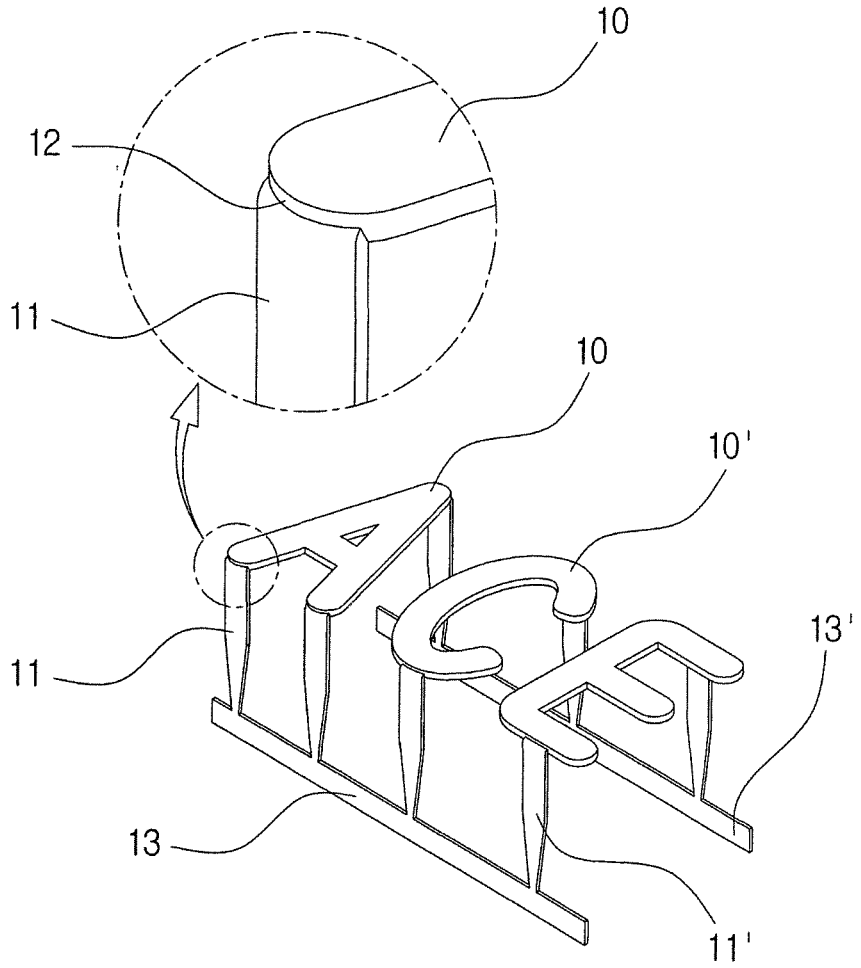
FIG. 4 is a view illustrating a bending process in the method of manufacturing and fixing a metal label according to the exemplary embodiment of the present invention.

In the state in which the etching process has been performed, the fixing legs 11 and 11' may be bent perpendicularly with respect to the metal labels 10 and 10' through a bending process, as illustrated in FIG. 4. At this time, edges of the metal labels 10 and 10' are not interfered in the bending process of the fixing legs 11 and 11' due to the stepped portion 12, and thus, sharpness in the edges of the metal labels 10 and 10' may be maintained as is.

Therefore, as the metal labels 10 and 10' are miniaturized or become delicate, a significantly high degree of sharpness thereof may be displayed and obtained, whereby the quality thereof may be further improved.

Figure 5:
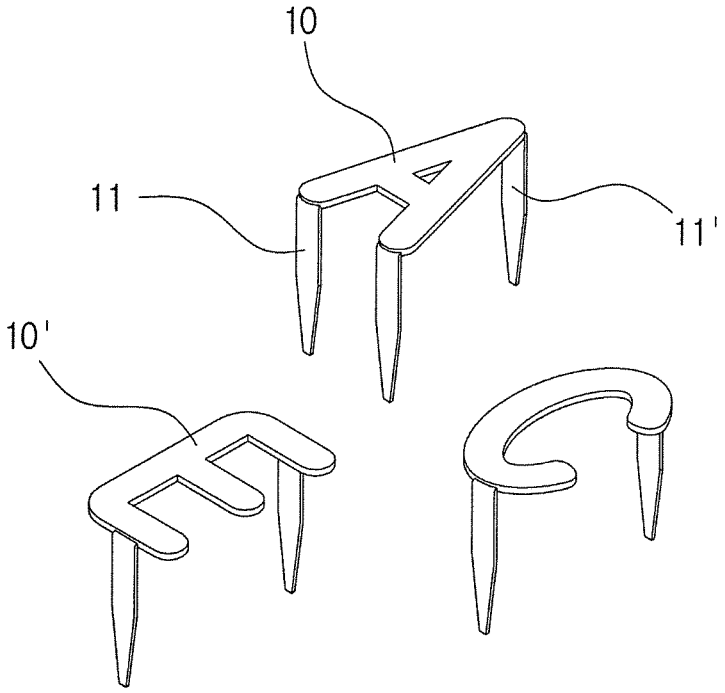
FIG. 5 is a view illustrating a cutting process in the method of manufacturing and fixing a metal label according to the exemplary embodiment of the present invention.

The metal labels 10 and 10' may be fixed to a product as is, in a case in which the metal labels 10 and 10' are formed as a single body. However, in a case in which the metal labels 10 and 10' are formed of a combination of two or more labels, since the connection members 13 and 13' connecting the ends of the fixing legs 11 and 11' to each other are formed, the connection members 13 and 13' may be cut and removed to allow the metal labels 10 and 10' to be individually separated as illustrated in FIG. 5.

In addition, a polishing process may be additionally performed on surfaces of the metal labels 10 and 10' in the state in which the etching process and the bending process have been performed. Accordingly, rough edges or the like of the metal labels 10 and 10' caused by press processing may be smoothly polished, and cut edges thereof or the like may also be rounded to be curved surfaces, whereby further improved quality may be obtained.

Furthermore, a plating process may be additionally performed on the surfaces of the metal labels 10 and 10' after the polishing process, whereby various metal texture and colors may be displayed. Due to the delicate bright plating process, further improved quality may be obtained.

Figure 6:
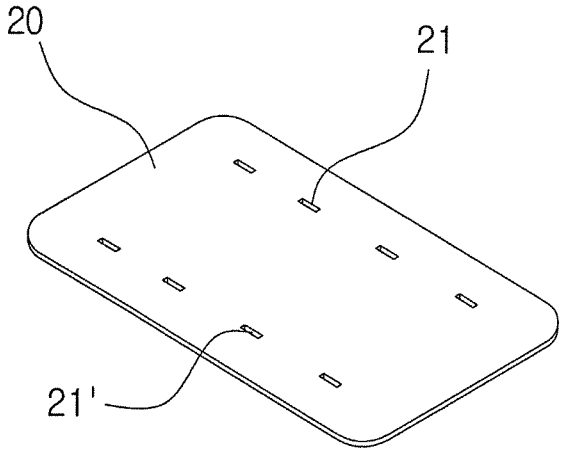
FIG. 6 is a view illustrating backplate processing in the method of manufacturing and fixing a metal label according to the exemplary embodiment of the present invention.

As described above, the label production process may be performed through the aforementioned processes. The backplate production process may be separately performed to form a metal plate through cutting. In the backplate production process, insertion holes 21 and 21' may be formed in the metal plate in positions corresponding to those of the fixing legs 11 and 11' bent from the metal labels 10 and 10' as illustrated in FIG. 6.

Figure 7:
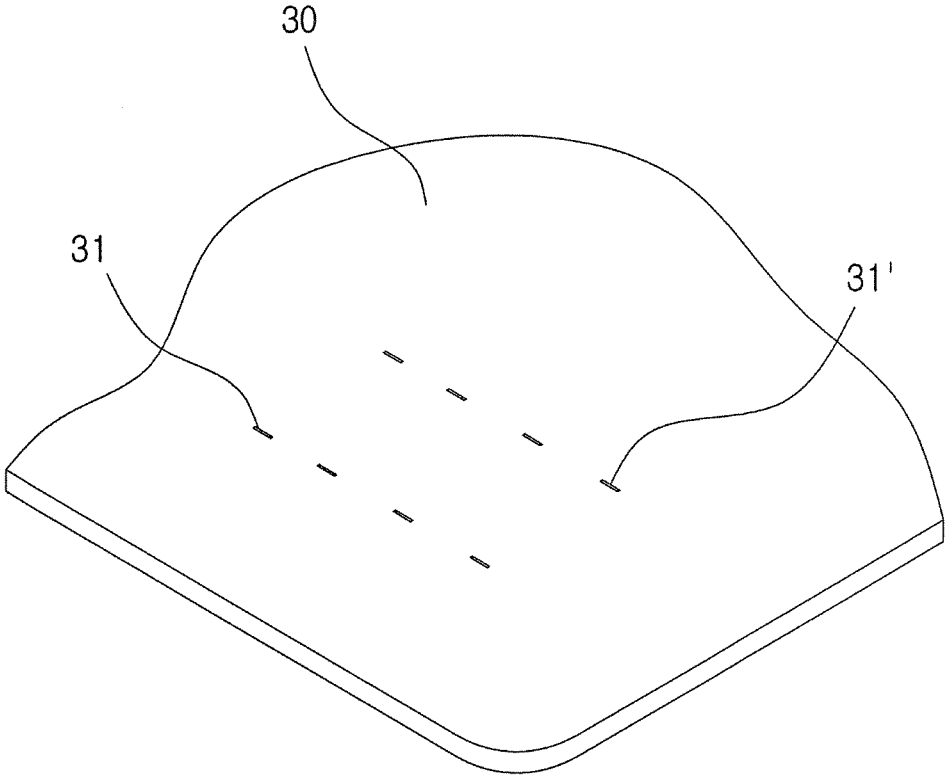
FIG. 7 is a view illustrating product processing in the method of manufacturing and fixing a metal label according to the exemplary embodiment of the present invention.

In addition, separately from the label production process and the backplate production process, the object punching process may be performed on the object to which the metal labels 10 and 10' are to be fixed. Through holes 31 and 31' may be formed in the object 30 in positions corresponding to those of the fixing legs 11 and 11' bent from the metal labels 10 and 10' as illustrated in FIG. 7.

Figure 8:
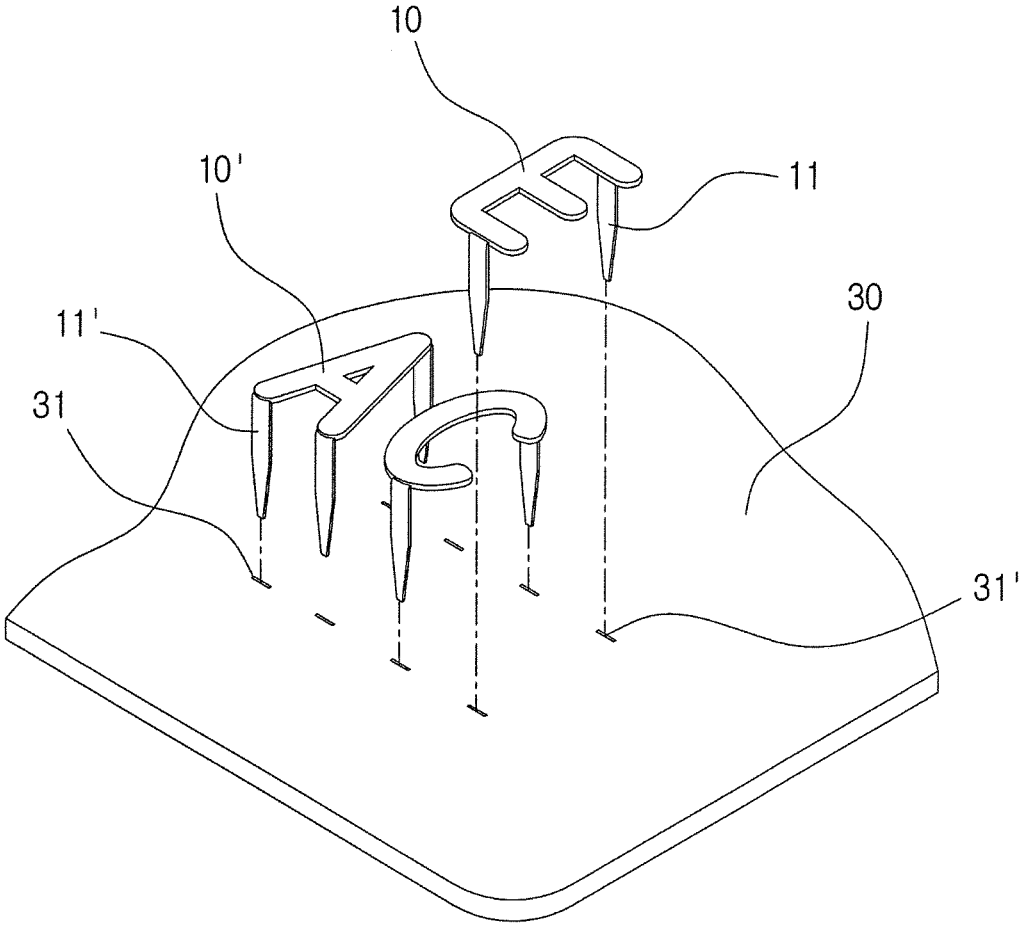
FIG. 8 is a view illustrating a metal label assembly process in the method of manufacturing and fixing a metal label according to the exemplary embodiment of the present invention.
Figure 9:
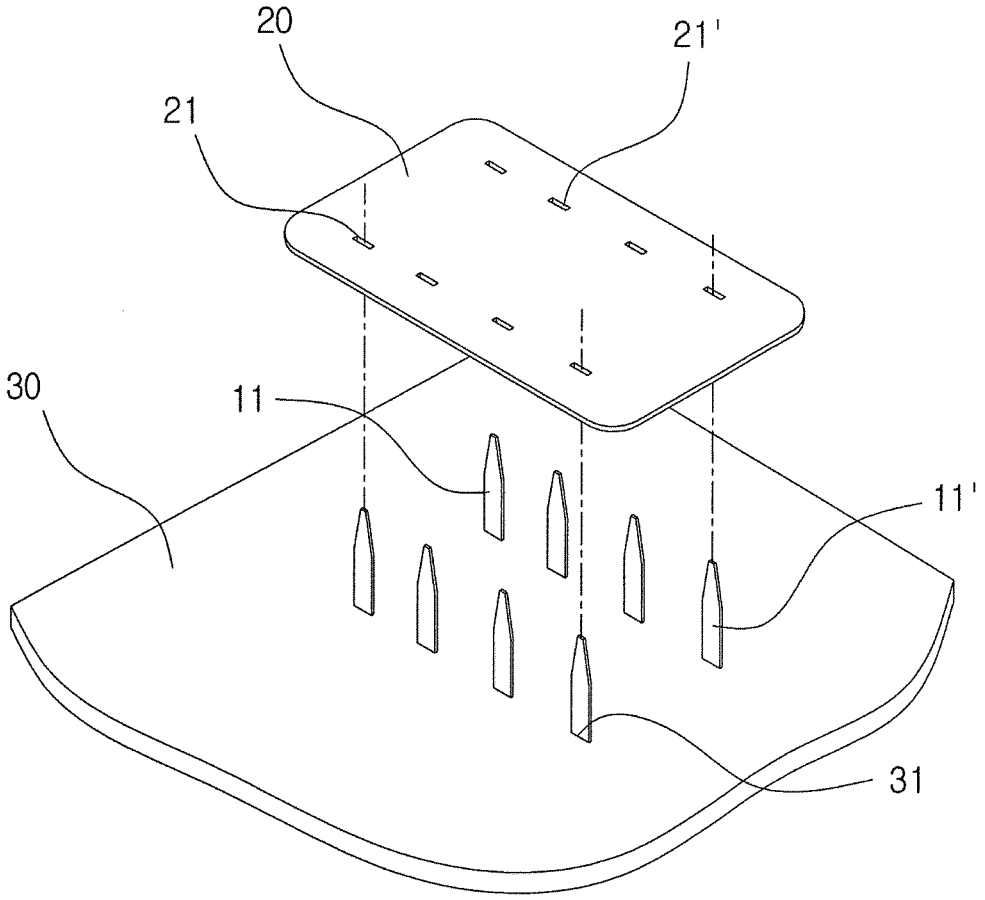
FIG. 9 is a view illustrating a backplate assembly process in the method of manufacturing and fixing a metal label according to the exemplary embodiment of the present invention.

After the production processes for the metal labels 10 and 10', the backplate 20 and the object 30 are completed, a label insertion process may be performed by inserting the fixing legs 11 and 11' into the through holes 31 and 31' of the object 30, respectively, as illustrated in FIG. 8. Then, a backplate coupling process may be performed by inserting the fixing legs 11 and 11' exposed after penetrating through the object 30 into the insertion holes 21 and 21' of the backplate 20, as illustrated in FIG. 9.

Figure 10:
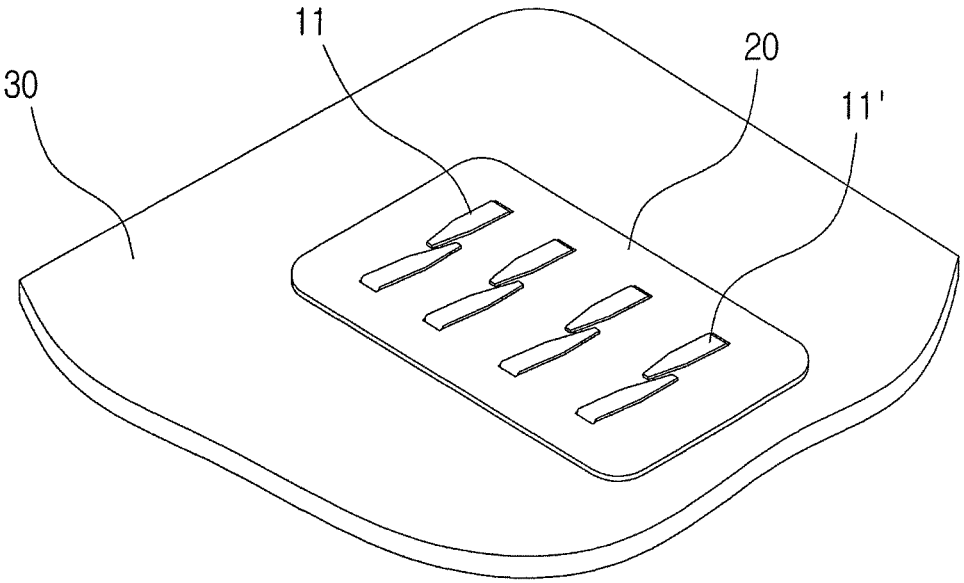
FIG. 10 is a view illustrating a coupling process of a backplate and fixing legs in the method of manufacturing and fixing a metal label according to the exemplary embodiment of the present invention.

In addition, when the backplate 20 is coupled as described above, a label fixation process may be performed by bending the fixing legs 11 and 11' exposed after penetrating through the insertion holes 21 and 21' of the backplate 20 so as to be closely attached to the backplate 20 as illustrated in FIG. 10.

Figure 11:
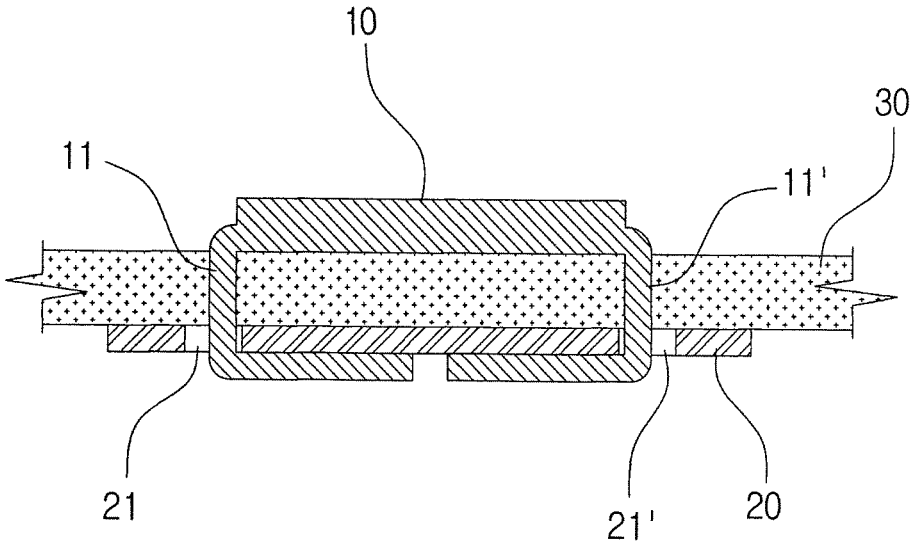
FIG. 11 is a cross-sectional view illustrating a completed assembly process in the method of manufacturing and fixing a metal label according to the exemplary embodiment of the present invention.

Therefore, the metal labels 10 and 10' may be firmly fixed through the fixing legs 11 and 11' penetrating through the object 30 and bent to be closely attached to the backplate 20 as illustrated in FIG. 11. Even in the case in which the metal labels 10 and 10' are formed of a combination of divided labels, since the insertion holes 21 and 21' of the backplate 20 and the through holes 31 and 31' of the object 30 are formed to consider the same interval, numerical values and data with respect to the positions of the fixing legs 11 and 11', such a combination of divided metal labels 10 and 10' may be fixed precisely in a horizontal or vertical state.

Figure 12:
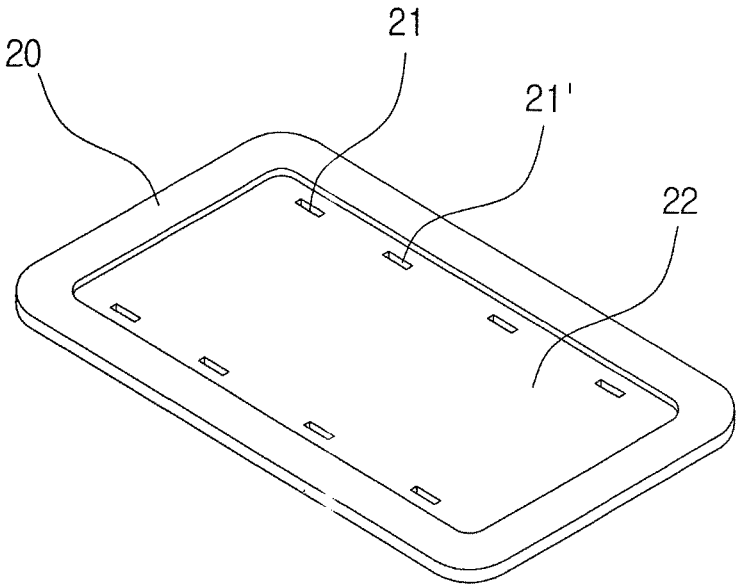
FIG. 12 is a view illustrating a process of forming a recess in one surface of a backplate in a method of manufacturing and fixing a metal label according to another exemplary embodiment of the present invention.
Figure 13:
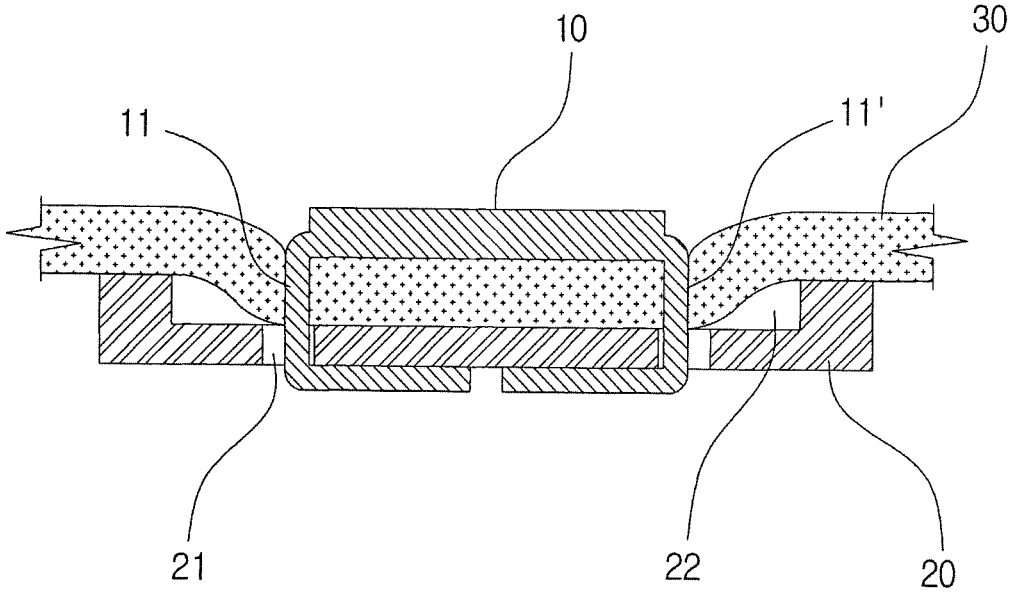
FIG. 13 is a cross-sectional view illustrating the coupling of the backplate and fixing legs of the metal label of FIG. 12.

Here, a recess may additionally be formed in the backplate 20, thereby preventing the metal labels 10 and 10' or the fixing legs 11 and 11' from protruding. In this manner, a surface or an internal surface of the product may be relatively smooth. As illustrated in FIG. 12, in a case in which the metal labels 10 and 10' are pressed and fixed to the object 30 in a state in which a receiving recess 22 may be formed in one surface of the backplate 20 facing the metal labels 10 and 10', the recess having a depth and a width corresponding to the thickness and width of the metal labels 10 and 10', the object 30 and the metal labels 10 and 10' may be embedded and inserted in the receiving recess 22 as illustrated in FIG. 13, whereby the metal labels 10 and 10' may not protrude from the surface of the object 30.

Therefore, the metal labels 10 and 10' are fixed in a non-protruding state, whereby the quality of the product may be further improved and various problems such as interference or the like caused by the protruding metal labels may be resolved.

Figure 14:
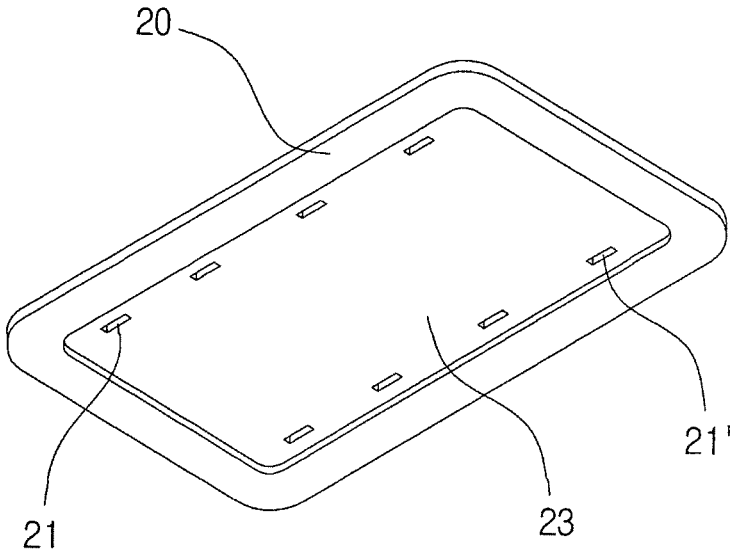
FIG. 14 is a view illustrating a process of forming a recess in the other surface of the backplate in a method of manufacturing and fixing a metal label according to another exemplary embodiment of the present invention.
Figure 15:
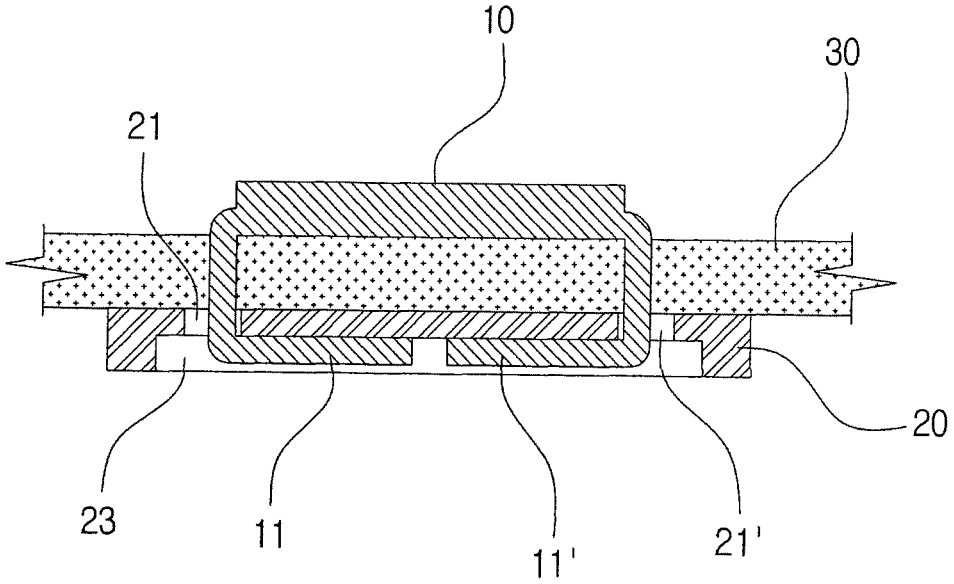
FIG. 15 is a cross-sectional view illustrating the coupling of the backplate and the fixing legs of the metal label of FIG. 14.

In addition, as illustrated in FIG. 14, a recess portion 23 may be formed in one surface of the backplate 20 to have a depth equal to or greater than the thickness of the fixing legs 11 and 11'. By forming the recess portion 23 in the surface of the backplate 20 to which the fixing legs 11 and 11' of the metal labels 10 and 10' are bent and closely attached, in the case in which the fixing legs 11 and 11' are bent, the fixing legs 11 and 11' may be placed inside the recess portion 23 of the backplate 20 as illustrated in FIG. 15. Therefore, when the product is used, interference with the fixing legs 11 and 11' resulting from the protrusion of the fixing legs 11 and 11', or damages to the product or injury of a user due to the protrusion of the fixing legs 11 and 11' may be prevented.

Figure 16:
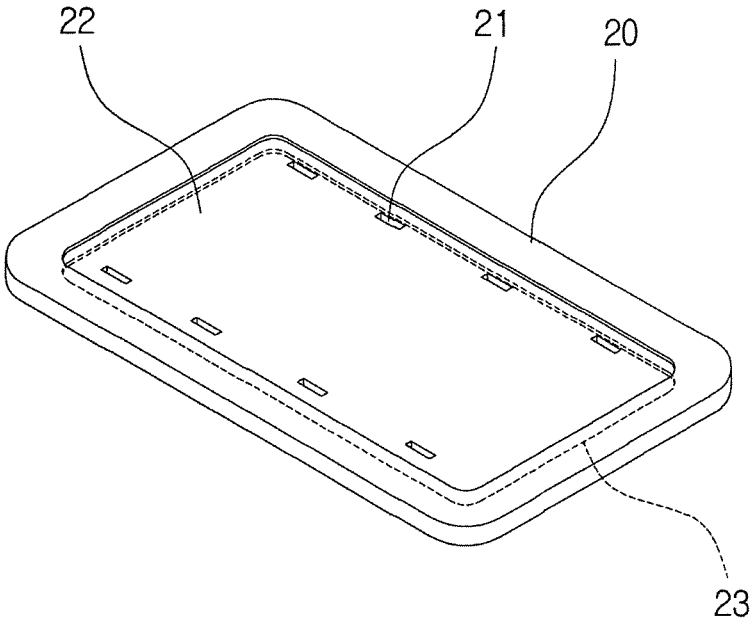
FIG. 16 is a view illustrating a process of forming recesses in both surfaces of the backplate in a method of manufacturing and fixing a metal label according to another exemplary embodiment of the present invention.
Figure 17:
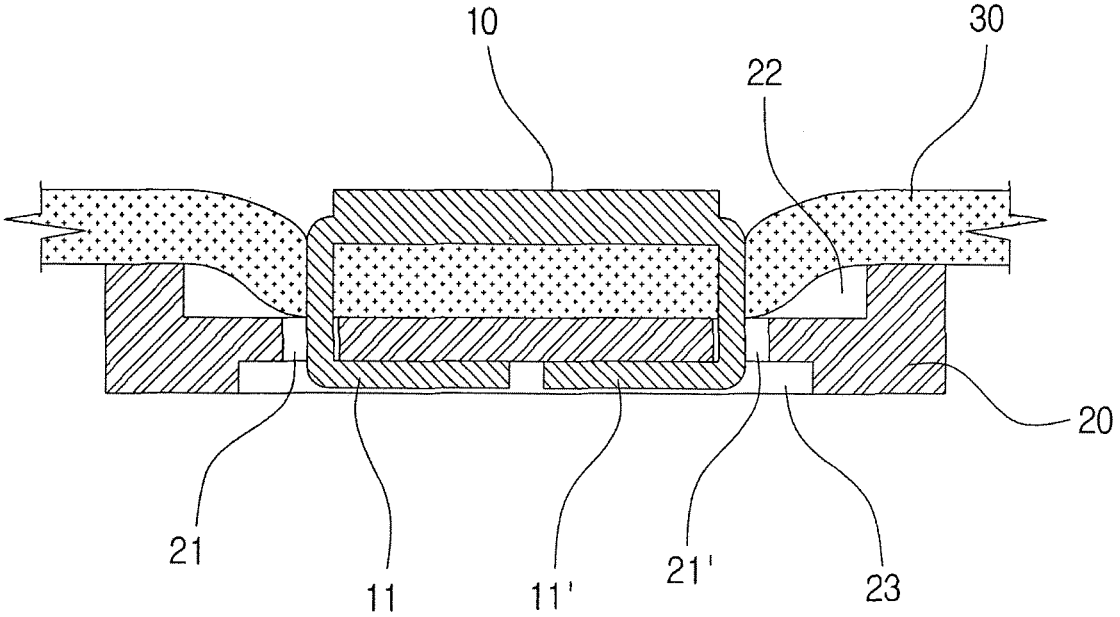
FIG. 17 is a cross-sectional view illustrating the coupling of the backplate and the fixing legs of the metal label of FIG. 16.

In addition, as illustrated in FIG. 16, the receiving recess 22 having a depth corresponding to the thickness of the metal labels 10 and 10' and the recess portion 23 having a depth corresponding to the thickness of the fixing legs 11 and 11' may be formed in both surfaces of the backplate 20, respectively. As illustrated in FIG. 17, the metal labels 10 and 10' may be positioned on the surface of the object 30 so as not to protrude due to the receiving recess 22, while the fixing legs 11 and 11' may be bent to not protrude from the surface of the backplate 20 due to the recess portion 23, whereby the exterior appearance of the product may be further improved, and the assembly process may be performed to secure stable usage.

In the method of manufacturing and fixing a metal label according to the exemplary embodiments of the present invention, miniaturized and delicate metal labels may be manufactured without damage to the edges thereof, resulting in significantly improved sharpness. Even in a case of a combination of divided labels, they may be fixed evenly without being displaced in an irregular manner. As necessary, the metal labels 10 and 10', the fixing legs 11 and 11', or both may be fixed effectively in a non-protruding state.

As set forth above, the metal labels may be manufactured to have sharp edges by forming the fixing legs to have a thickness different from that of the metal labels such that the fixing legs may not affect the edges of the metal labels even when the fixing legs are bent. By reducing the thickness of the fixing legs, damage to the product may be minimized and workability may be improved. In addition, a recess having a depth corresponding to the thickness of the metal labels or the fixing legs may be formed in the backplate for fixing the metal labels, thereby preventing the metal labels or the fixing legs from protruding from the surface of the product or the surface of the backplate, whereby further improved quality and exterior appearance of the product may be obtained.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A method of manufacturing and fixing a metal label, the method comprising:

performing a label production process including a masking process performed on a metal plate by taping a portion of both surfaces of the metal plate corresponding to a metal label to be formed and taping a portion of one surface of the metal plate corresponding to fixing legs connected to the metal label, an etching process for etching the masked metal plate to retain the metal label and the fixing legs while allowing the fixing legs which have been further etched to be thinner than the metal label, and a bending process for bending the fixing legs from the metal label;

performing a backplate production process in which insertion holes are formed in a backplate in positions corresponding to those of the fixing legs of the metal label;

performing an object punching process in which through holes are formed in an object in positions corresponding to those of the fixing legs of the metal label;

performing a label insertion process by inserting the fixing legs of the metal label into the through holes of the object;

performing a backplate coupling process by allowing the fixing legs penetrating through the object to be inserted into the insertion holes of the backplate; and performing a label fixation process by bending the fixing legs protruding after penetrating through the backplate, wherein the label production process, the backplate production process, and the object punching process are separately performed, and then the label insertion process, the backplate coupling process, and the label fixation process are sequentially performed.

2. The method of claim 1, wherein the etching process includes:

forming a connection member connecting ends of the fixing legs to one another in a case in which the metal label is formed of a combination of two or more labels; and removing the connection member by additionally performing a cutting process after the bending process of the fixing legs.

3. The method of claim 1, wherein the label production process further includes:

performing a polishing process on an exposed surface of the metal label after the etching process; and performing a plating process on the polished surface of the metal label.

4. The method of claim 1, wherein the backplate production process includes forming a receiving recess in a surface of the backplate facing the metal label, the receiving recess having a depth corresponding to a thickness of the metal label, such that the metal label is embedded in and fixed to the receiving recess.

5. The method of claim 1, wherein the backplate production process includes forming a recess portion in a surface of the backplate to which the fixing legs are bent and attached, the recess portion having a depth corresponding to a thickness of the fixing legs, such that the fixing legs are allowed to be bent in a non-protruding state.

6. The method of claim 1, wherein the backplate production process includes forming a receiving recess and a recess portion in both surfaces of the backplate, the receiving recess having a depth corresponding to a thickness of the metal label and the recess portion having a depth corresponding to a thickness of the fixing legs, such that the metal label is fixed and the fixing legs are bent in a non-protruding state.

* * * * *